United States Patent [19]

Steuer et al.

[11] Patent Number: 4,923,143

[45] Date of Patent: May 8, 1990

[54] PROJECTILE HAVING EXTENDABLE WINGS

[75] Inventors: Raimar Steuer, Leinburg; Manfred Kraus, Eckental, both of Fed. Rep. of Germany

[73] Assignee: Diehl GmbH & Co., Nuremberg, Fed. Rep. of Germany

[21] Appl. No.: 428,843

[22] Filed: Oct. 30, 1989

[30] Foreign Application Priority Data

Nov. 15, 1988 [DE] Fed. Rep. of Germany ..... 3838738

[51] Int. Cl.[5] ..... F42B 13/32; F42B 15/053

[52] U.S. Cl. ..... 244/3.28; 244/49

[58] Field of Search ..... 244/3.27, 3.28, 49

[56] References Cited

U.S. PATENT DOCUMENTS 3,788,578 1/1974 Sweeney et al. .
3,826,448 7/1974 Burk, Jr. .
3,990,656 11/1976 Minnich .
4,022,403 5/1977 Chiquet .
4,364,531 12/1982 Knoski .
4,659,038 4/1987 Hoeppner et al. .
4,664,338 5/1987 Steuer et al. .

*Primary Examiner*—Charles T. Jordan
*Assistant Examiner*—Richard W. Wendtland
*Attorney, Agent, or Firm*—Scully, Scott, Murphy & Presser

[57] ABSTRACT

A projectile, an airborne body or a missile, such as an article of ammunition, having extendable wings, whereby a wing covering is provided to extend between a front spar which is extendable through the action of a power element, and a rear spar which is retractable with its outer end against the front spar, as well as providing for a specially adapted power element for this purpose. The power element has one end thereof engaging at the front spar and has its opposite end engaging against a slider which is latched to the projectile so as to be supported thereon for displacement along the longitudinal direction, and wherein the rear spar has its inner end pivotable in front of the slider in the direction of displacement thereof, and upon the slider being unlatched, is pivotable further by the slider under the action of the power element for effectuating the tensioning of the wing covering.

6 Claims, 2 Drawing Sheets

PROJECTILE HAVING EXTENDABLE WINGS

BACKGROUND OF THE INVENTION

1. Field of the Invention

The present invention relates to a projectile, an airborne body or a missile, such as an article of ammunition, having extendable wings, whereby a wing covering is provided to extend between a front spar which is extendable through the action of a power element, and a rear spar which is retractable with its outer end against the front spar, as well as with the provision of a specially adapted power element for this purpose.

2. Discussion of the Prior Art

A projectile with such a wing construction of that type is known from the disclosure of German Laid-Open Patent Appln. No. 33 40 501 (corresponding to U.S. Pat. No. 4,664,338), which is assigned to the common assignee of the present application. Arranged intermediate the inner end of the front spar and the inner end of the rear spar is an articulated longitudinal rod through the intermediary of which the rear spar is lockable in its outwardly extended position. The length of the longitudinal rod limits the possible tensioning of the wing covering. In the disclosure of German Laid-Open Patent Application No. 34 03 573 (also corresponding to U.S. Pat. No. 4,664,338) there is described an improved construction relative to the above-mentioned German application, in which a rigid rocker arm is provided instead of the articulated longitudinal rod, which rocker arm extends the rear spar. Also in this instance will the length of the rocker arm limit the possible tensioning of the wing covering.

SUMMARY OF THE INVENTION

Accordingly, it is an object of the present invention to contemplate the provision of a projectile of the above-mentioned type in that the capability in the tensioning of the wing covering is improved with the utilization of a simple construction.

Inventively, the foregoing object is attained for a projectile of the above-mentioned type in that the power element has one end thereof engaging at the front spar and has its opposite end engaging against a slider which is latched to the projectile so as to be supported thereon for displacement along the longitudinal direction, and wherein the rear spar has its inner end pivotable in front of the slider in the direction of displacement thereof, and upon the slider being unlatched, is pivotable further by the slider under the action of the power element for effectuating the tensioning of the wing covering.

Upon the extension of the wing, the power element at first swings the front spar outwardly. During this interval, the slider is locked in place. The rear spar pivots opposite to the front spar and latches in front of the slider. As a result, this causes the unfolding of the wing covering. The locking of the slider is then released, and the latter thereby presses against the rear spar in such a manner that the wing covering is finally stiffly tensioned by means of the remaining energy of the power element. In this instance, it is also expedient that for effectuating the stiff-tensioning it is not necessary to provide an individual power element.

In a preferred embodiment of the invention, the rear spar, which has been pivoted in front of the slider, unlatches the slider. As a consequence, this will then ensure that the slider will be unlatched only when the rear spar is in its correct position for the stiff-tensioning of the wing covering.

BRIEF DESCRIPTION OF THE DRAWINGS

Further advantageous embodiments and features of the invention may now be readily ascertained from the following detailed description of an exemplary embodiment thereof, taken in conjunction with the accompanying drawings; in which.

DETAILED DESCRIPTION

Figure 1:
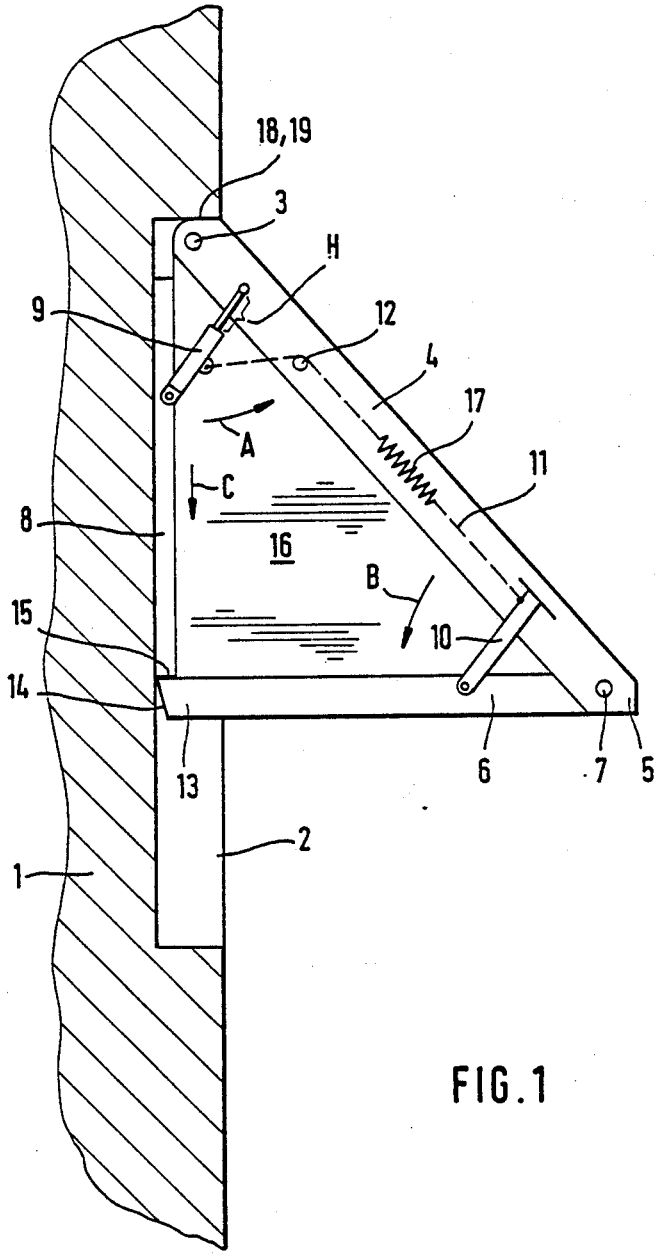
FIG. 1 illustrates a wing of a projectile shown in an extended position.

On the fuselage or body 1 of the projectile there is provided a longitudinal groove 2. Supported within this groove is a front spar 4 for outward extension about a pivot 3. At the outer end 5 of the front spar there is connected a rear spar 6 so as to be retractable about an axle or pivot 7.

Arranged on the bottom of the longitudinal groove 2 is a slider 8 in a manner such as to be displaceable along the longitudinal direction of the groove. A power element 9 is hingedly connected at one end thereof to the front spar 4 and with its opposite end to the slider 8. A lever 10 has one end thereof hingedly connected to the rear spar 6. The other end of the lever is slidably guided along the front spar 4 in the longitudinal direction of the latter. Engaging this end of the lever pull or tension cable 11 which is guided about a pin 12 on the front spar 4, and which has the power element 9 attached thereto.

The rear spar 6 possesses a free or unrestrained inner end 13 on which there is formed an inclined surface or bevel 14 and a contact edge 15.

A covering 16 for the wing is fastened to the front spar 4 and to the rear spar 6.

In the development of the tension cable 11 there is arranged a spring 17 in order to form an extension compensator or balance. The front spar 4 forms a stop 18 which, in the extended position of the front spar 4 (as shown in FIG. 1), contacts against an end edge 19 of the longitudinal groove 2.

Figure 2:
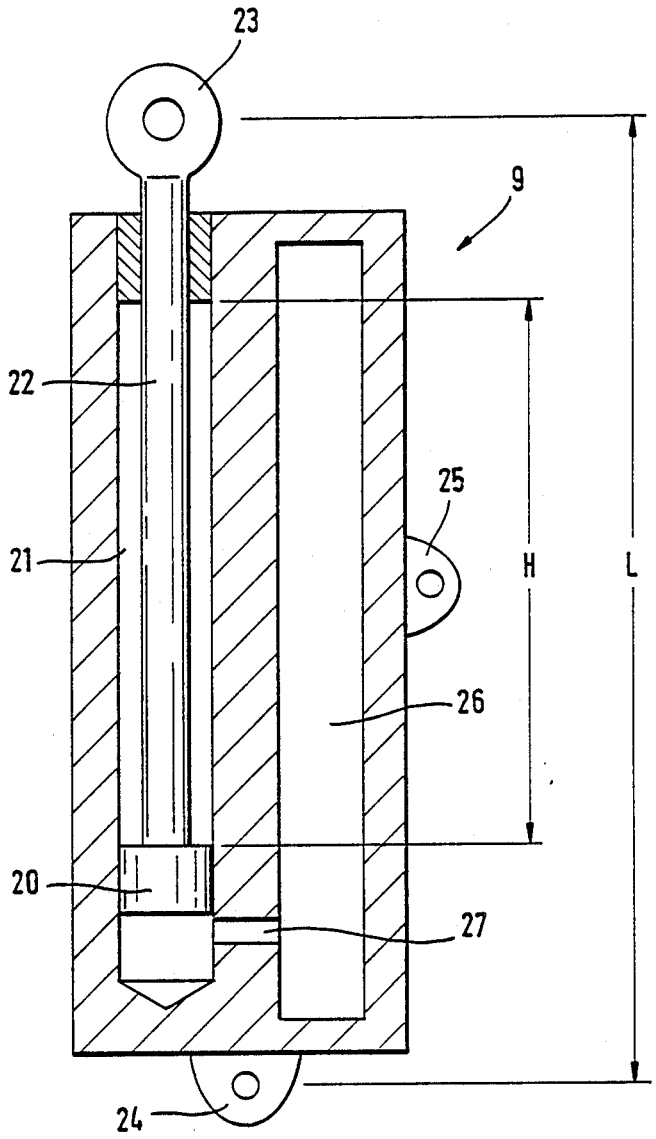
FIG. 2 generally diagrammatically illustrates a preferredly employable power element for effectuating the extension of the wing substantially pursuant to FIG. 1, which is also accorded an inherent patentability.

The power element 9 can be formed by any energy storage or accumulator with linear motion components, whose direction of expansion is oriented in such a manner that it will swing the front spar 4 about the pivot 3, as well as being able to displace the slider 8 in a longitudinal direction. In FIG. 2 there is illustrated a preferred actual constructional embodiment for such a power element 9. This power element possesses a piston 20 which is guided within a cylinder 21. A piston rod 22 which is connected with the piston 20 is hingedly connected through the intermediary of an eyelet 23 with the front spar 6. A connecting lug 24 on the housing of the power element 9 is hingedly connected to the slider 8. The pull or tension cable 11 is fastened to a mounting 25.

Adjacent the cylinder 21, a gas pressure chamber 26 is formed in the power element 9, which chamber communicates with the cylinder 21 through an opening 27. As a consequence of the gas pressure chamber 26 being arranged adjacent the cylinder 21, it possesses a sufficiently large volume without any need for increasing the installation length L.

In FIG. 2 there is illustrated the power element 9 in its non-extended condition. The possible stroke or displacement H of the piston 20 within the cylinder 21 corresponds to the path of movement which is necessary in order to extend the front spar 4 outwardly and to displace the slider 8 for the final tensioning of the wing covering 16. The gas pressure chamber 26, for example, is filled with compressed air.

The mode of operation of the above-described arrangement is generally somewhat as follows:

In the initial or starting condition (not shown) the front spar 4 and the rear spar 6 are located within the longitudinal groove 2. The slider 8 is locked in place and the power element 9 assumes the non-extended position which is illustrated in FIG. 2.

After the release of the front spar 4 from the longitudinal elongate groove 2, or the activation of the power element 9, then by means of the action of the power element 9 the front spar 4 is swung out from the longitudinal groove 2 about the pivot 3 in the direction of the arrow A until the stop 18 strikes against the end edge 19. Concurrently, the tension cable 11 pulls on the lever 10 such that the latter presses the rear spar 6 away from the front spar 4 about the ale or pivot 7 in the direction of the arrow B. As a result, there unfolds the wing covering 16. The slider 8 is still locked in place.

The rear spar 6 then pivots with its inner end 13 in the direction of movement of the slider 8. Thereby, it releases the locking of the latter. The slider 8 then presses, under the action of the remaining energy of the power element 9, in the direction of the arrow C against the contact edge 15 so that the rear spar 6 is swung further until the wing covering 16 is stiffly tensioned. During the flight of the projectile, the pressure which acts on the piston 20 maintains the wing covering 16 in a stiffly tensioned condition.

What is claimed is:

1. A projectile having extendable wings; comprising an extendable front spar; a power element for extending said front spar; a rear spar having an outer end connected to said front spar and being retractable against said front spar; a wing covering extending between said front and rear spars, said power element having one end engaging the front spar and an opposite end engaging a slider which is axially displacably locked on the projectile in a longitudinal direction thereof, said rear spar having an inner end pivotable in front of the slider in the direction of movement of said slider, and upon the slider being unlocked being pivoted further by said slider under the action of said power element for effectuating tensioning of said wing covering.

2. A projectile as claimed in claim 1, wherein said rear spar which is pivoted ahead of the slider unlocks the slider to allow for displacement thereof.

3. A projectile as claimed in claim 1, wherein a lever engages said rear spar; a tension cable being fastened to the lever, said tension cable pressing the rear spar away from the front spar during the outward extension of said front spar.

4. A projectile as claimed in claim 3, wherein said tension cable is fastened to the power element.

5. A projectile as claimed in claim 1, wherein the outwardly extended front spar is pressed by said power element against a stop contact in said groove.

6. A power element for use with a projectile as claimed in claim 1, comprising a piston guided within a cylinder, and a gas pressure chamber being arranged adjacent said cylinder and which is in operative communication with said cylinder.

* * * * *